United States Patent [19]

Courter

[11] 4,125,912

[45] Nov. 21, 1978

[54] WATERBED FRAME STRUCTURE

[76] Inventor: Mark L. Courter, 4723 S. Mill Ave., Tempe, Ariz. 85282

[21] Appl. No.: 827,003

[22] Filed: Aug. 23, 1977

[51] Int. Cl.[2] ..... A47B 27/08; A47B 43/00

[52] U.S. Cl. ..... 5/370; 5/201; 5/286; 5/288; 312/265

[58] Field of Search ..... 5/200 R, 200 B, 203–282 A, 5/286, 288, 370, 265; 312/330

[56] References Cited

U.S. PATENT DOCUMENTS

| | | | |
|---|---|---|---|
| 2,427,012 | 9/1947 | Lum | 312/265 |
| 3,724,007 | 4/1973 | Kuss | 5/370 |
| 3,761,974 | 10/1973 | Kuss | 5/370 |
| 3,822,423 | 7/1974 | Watts | 5/282 R |
| 3,885,845 | 5/1975 | Krieks | 312/265 |

*Primary Examiner*—Casmir A. Nunberg
*Attorney, Agent, or Firm*—Herbert E. Haynes, Jr.

[57] ABSTRACT

A wooden waterbed frame structure including a pedestal assembly for supporting a mattress frame with the corner joints on both the pedestal assembly and the mattress frame being of special interlocking configuration to facilitate assembly and produce a durable product of exceptional structural strength.

6 Claims, 4 Drawing Figures

WATERBED FRAME STRUCTURE

BACKGROUND OF THE INVENTION

1. Field of the Invention

This invention relates to bed structures and more particularly to a frame structure for waterbeds.

2. Description of the Prior Art

Waterbeds have become very popular in the last several years and, as is well known, waterbed frames differ substantially from conventional bed frames due to the different structural requirements imposed thereon by the characteristics of the waterbed mattress.

In general, waterbed frames include a pedestal assembly for supporting a mattress frame. The pedestal assembly is usually in the form of an open rectangular frame having a free-standing cross-shaped support structure therein and upon which a planar platform is supported. The mattress frame is also an open rectangular structure which provides upstanding side walls for supporting the periphery of the waterbed mattress which is positioned within the mattress frame atop the planar platform of the pedestal assembly.

A waterbed mattress is normally a rectangularly shaped flexible bag of plastic material for containing water in amounts which range from approximately 50 gallons for a child's bed to about 350 gallons for a king size bed. The weight of the water along with the static and kinetic loads imposed by the water, both vertically and laterally, make it imperative that a waterbed frame be structurally sound. To meet the rather stringent structural requirements, the rectangular frame of the pedestal assembly and the rectangular structure which forms the mattress frame are made of 2 × 8 inch or 2 × 10 inch wooden planks of suitable length.

In addition to using structurally strong wooden planks, the corner joints employed to assemble the required rectangular structures are factors which must be considered.

Prior art waterbed frames are fabricated with butt joints at the corners of the rectangular frames, and the butt joints are held by hinge mechanisms which extend almost the full length of the joints. The hinges are mounted on the inwardly facing surfaces of the planks and are affixed thereto by wood screws. As is well known in the cabinetmaking art, a butt joint is the weakest joint of the type commonly used to form corners and the like. It is also well known that to use wood screws alone as fastening hardware is generally a poor practice, and is particularly poor when wood so joined is subject to stresses due to vibrations, loading and the like.

In addition to the inherent structural weakness of the prior art corner joints, such joints have other shortcomings. First, employing a hinge as described above is time consuming from the assembly standpoint and provides little or no deterrent to warpage of the wooden planks which, besides producing an unsightly structure, can loosen the wood screws which hold the hinge in place. Secondly, locating the hinges on the inwardly facing plank surfaces exposes the plastic waterbed mattress, and liner if used, to relatively sharp edges which can, and sometimes does, result in punctures and abrasive wear of those plastic items. Third, water movements produced by movements of the bed's occupants will result in undulating movement of the mattress which in turn applies uneven and erratic loading of the mattress frame which causes the corner joints to work, i.e., the planks move independently of each other. Such working of the corner joints will eventually result in the loosening of the wood screws.

Therefore, a need exists for a new and useful waterbed frame structure which overcomes some of the problems and shortcomings of the prior art.

SUMMARY OF THE INVENTION

In accordance with the present invention, a new and improved waterbed frame structure is disclosed as including a pedestal assembly for supporting a mattress frame, with the corner joints employed in construction thereof being of special interlocking configuration which facilitates assembly and produces a waterbed frame structure of exceptional strength, durability and versatility.

The pedestal assembly includes an open rectangularly shaped frame in which a free-standing cross-shaped support structure is placed, and upon which a planar platform is supported. The mattress frame is also an open frame structure of rectangular configuration which provides upstanding side walls for supporting the periphery of a waterbed mattress which is placed therein atop the planar platform of the pedestal assembly.

The rectangular frames which are used in the pedestal assembly and which form the mattress support structure are each fabricated with corner joints which are known as open mortise and tenon joints in the cabinetmaking art. When the elements of the corner joints are formed and the planks are in place, the joint is drilled to provide a bore which is transverse to the longitudinal dimensions at the juncture of the planks being joined, and a carriage pin or bolt is slidingly inserted into the bore.

Thus the waterbed frame of the present invention employs inherently strong corner joints which are simple to construct and assemble and are easy to disassemble for moving purposes. Also, the pinned open mortise and tenon joints deter plank warpage, cannot wear or puncture a mattress or liner, and are free to work without any resulting problems.

In addition to the above, the open mortise and tenon corner joints allows the side wall planks of the mattress frame to be configured to extend beyond the corner joints to provide supporting structure upon which a headboard and/or footboard can be mounted.

Accordingly, it is an object of the present invention to provide a new and improved waterbed frame structure.

Another object of the present invention is to provide a new and useful waterbed frame structure which employs interlocking corner joints at the various corners thereof.

Another object of the present invention is to provide a new and useful waterbed frame structure having the various corner joints thereof configured in the form of open mortise and tenon joints which are demountably secured by carriage pins slidably positioned in a bore formed through the joint elements.

Another object of the present invention is to provide a new and improved waterbed frame structure which includes a pedestal assembly having a rectangular open frame upon which a planar platform is carried for supporting a rectangular open mattress supporting frame, with those rectangular frames being provided with corner joints of open mortise and tenon configuration which are assembled with pins.

Still another object of the present invention is to provide a new and useful waterbed frame structure of the above described character having the side wall planks of the mattress supporting frame extending beyond the corner joints for supporting a headboard and/or a footboard.

The foregoing, and other objects of the present invention, as well as the invention itself may be more fully understood from the following description when read in conjunction with the accompanying drawings.

DESCRIPTION OF THE PREFERRED EMBODIMENTS

Figure 1:
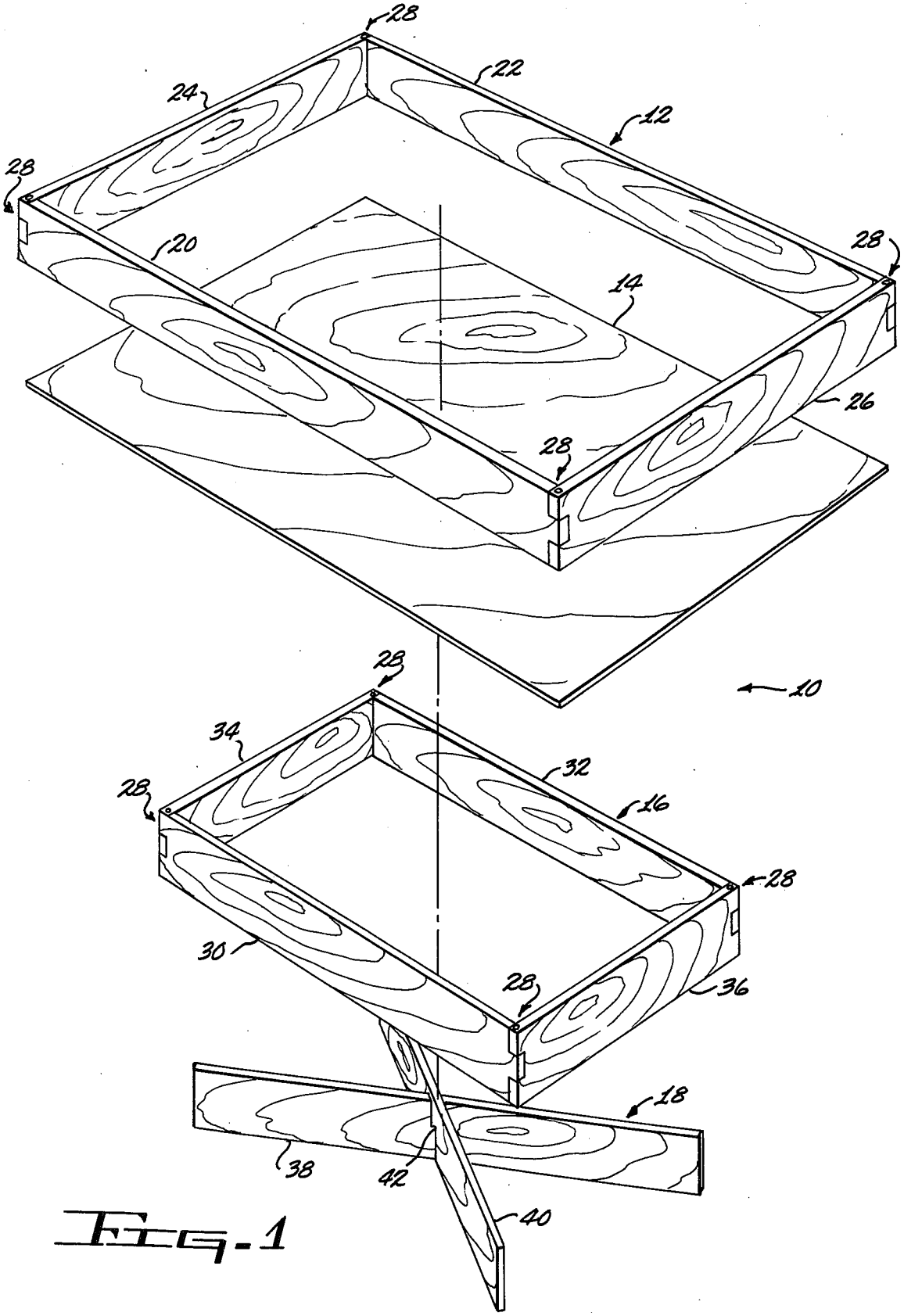
FIG. 1 is a perspective exploded view of the waterbed frame structure of the present invention illustrating the various features thereof.

Referring more particularly to the drawings, FIG. 1 illustrates the waterbed frame structure of the present invention which is indicated generally by the reference numeral 10. As will hereinafter be described in detail, the waterbed frame structure 10 includes a mattress support frame 12, a planar platform 14, a pedestal frame 16 and a free-standing cross-shaped support 18.

The mattress support frame 12 is seen to be an open generally rectangular structure having a spaced apart parallel pair of side wall members or planks 20 and 22 which are interconnected by a spaced pair of parallel end walls or planks 24 and 26. The side and end walls 20, 22, 24 and 26 are formed of wooden planks of suitable lengths and have cross sectional dimensions which preferably measure 2 × 8 inches or 2 × 10 inches. The side and end walls 20, 22, 24 and 26 are interconnected by special interlocking corner joints which are indicated generally by the reference numeral 28, and those joints will hereinafter be described in detail.

Immediately below the mattress frame 12, the planar platform 14 is positioned to support the mattress frame. The platform 14 is of rectangular configuration which is normally sized somewhat larger than the inside dimensions of the mattress frame 12 so that the peripheral edges of the platform 14 will fit in an endless inwardly and downwardly facing groove (not shown) formed in bottom and inwardly disposed corners of the side and end walls 20, 22, 24 and 26 of the mattress frame 12. When the mattress frame 12 and the planar platform 14 are assembled as described above, suitable fasteners, such as wood screws (not shown), may be employed if desired to fasten the platform 14 to the mattress frame 12. Otherwise, the mattress frame 12 can simply be placed atop the platform 14. The planar platform 14 is preferrably formed of a sheet of plywood with the thickness thereof being determined by weight and size of the particular bed. For example, half inch plywood will usually be sufficient for smaller beds such as a child's bed with three-quarter inch plywood being employed for the larger beds.

It should be understood that the above described mattress frame 12 and planar platform 14 constitute a complete bed frame of themselves, and can be supported on a floor without benefit of the pedestal frame 16 and cross-shaped support 18. However, for appearance and convenience purposes, it is preferred and is customary that the mattress frame 12 and planar platform 14 be supported on the pedestal frame 16 and the cross-shaped support 18.

The pedestal frame 16 is seen to be an open generally rectangular structure similar to the above described mattress support frame 12 but preferably is smaller with regard to its length and width dimensions. The pedestal frame 16 includes a spaced apart parallel pair of side wall members or planks 30 and 32 which are interconnected on their aligned opposite ends by a pair of end wall members or planks 34 and 36. It is preferred that the side and end wall members 30, 32, 34 and 36 be fabricated of wooden planks having suitable length dimensions and having cross sectional dimensions which measure 2 × 6 inches, 2 × 8 inches or 2 × 10 inches, as determined by the desired height of the waterbed frame structure 10. The side and end wall members are preferrably interconnected by the same special interlocking corner joints 28 which are used in the mattress frame 12, and as will hereinafter be described in detail.

As is customary in waterbed frames, the free-standing cross-shaped support 18 is placed within the pedestal frame 16 to help support the load of the waterbed mattress (not shown) and the supporting structure thereof. The cross-shaped support 18 usually comprises a pair of planks 38 and 40, each of which is suitably notched, such as at 42, to allow the assembly thereof as shown. The planks 38 and 40 may be of any convenient thickness dimension and must have a height dimension which is the same as the height dimension of the side and end wall planks 30, 32, 34 and 36 of the pedestal frame 16.

Figure 2:
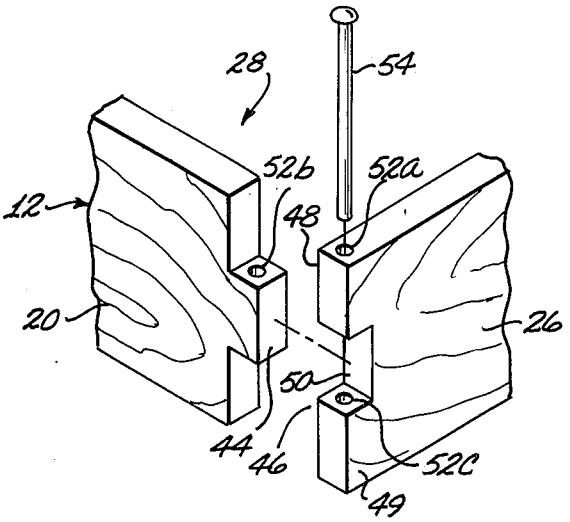
FIG. 2 is an enlarged fragmentary isometric exploded view of a typical corner joint employed in the construction of the waterbed frame structure of the present invention.

Referring now to FIG. 2 wherein a typical one of the corner joints 28 is shown. It will be understood that although the following description of the corner joint 28 is described with regard to a particular corner joint on the mattress support frame 12, the described joint 28 is typical of all the corner joints employed in the mattress support frame 12 and the pedestal frame 16.

As shown, the corner joint 28 is of the type known as an open mortise and tenon joint, with the tenon 44 being cut or otherwise formed on the end of elongated side wall member 20 of the mattress support frame 12. The open mortise 46 is formed on the end of the end wall member 26 and is inherently provided with a spaced pair of projections 48 and 49 separated by a gap 50. To insure maximum strength, it is preferred that the tenon 44 has a height dimension which is approximately one third of the height dimension of the side wall plank 20 and is centrally located along that latter height dimension. Likewise, the spaced projections 48, 49 and the gap 50 therebetween are preferrably each formed with a height dimension which is approximately one third of the height of the end wall plank 26. In forming the tenon 44 and the open mortise 46 it is preferred that they be cut so as to provide a relatively loose fit which will allow the corner joint to work, i.e., the planks will move relative to each other. In other words, the fit of the open mortise and tenon joint should be snug but not an interference fit, which in addition to allowing the corner joint to work, will allow the planks to swell and shrink due to varying moisture content.

When the above described open mortise and tenon corner joint 28 is formed as described above, and assembled as shown in FIG. 1, an aligned three segment bore 52*a*, 52*b* and 52*c* is drilled or otherwise formed through the joint so as to be transverse to the longitudinal dimensions of side and end wall planks 20 and 26, respectively. Thus, the bore, as shown best in FIG. 2, will have the first or upper segment 52*a* thereof formed through the projection 48, the intermediate segment 52*b* formed through the tenon 44, and the lower or third segment 52*c* formed through the projection 49.

The open mortise and tenon joint 28 formed as described above is demountably fastened by an elongated headed pin 54, which may be a carriage bolt, with the pin 54 being slidingly inserted into the three segment bore 52*a*, 52*b* and 52*c*.

Figure 3:
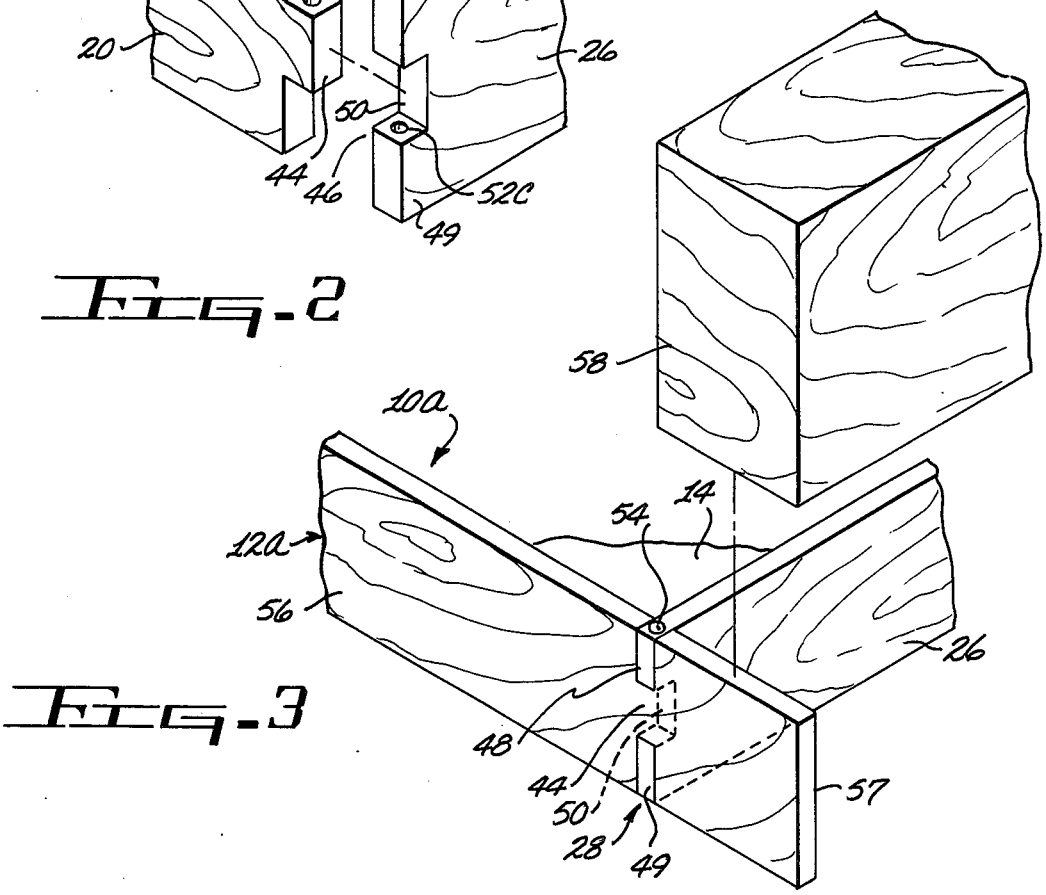
FIG. 3 is a fragmentary isometric exploded view illustrating a modification of the waterbed frame structure of the present invention.

Reference is now made to FIG. 3 wherein a fragmentary portion of a second embodiment of the waterbed frame structure of the present invention is indicated generally by the reference numeral 10*a*. In this second embodiment, all the various elements previously described with reference to the waterbed frame structure 10 are the same except that the elongated side wall members 20 and 22 of the mattress support frame 12 are replaced in the mattress support frame 12*a* of the frame 10*a* by an identical pair of side wall planks 56 (one shown). In the mattress support frame 12*a* of this second embodiment, the side wall planks 56 are each provided with an extending projection 57 (one shown) which protrudes beyond the end wall plank 26. In this manner, a bookcase type of headboard 58 may be supported upon those projections 57 (one shown). It will be understood that this same type of construction can be employed at the opposite end of the mattress support frame 12*a* to support a footboard (not shown). The main body portion of the side wall planks 56 are integral with the extending projections 57 thereof by means of the tenons 44 of the corner joints 28.

Figure 4:
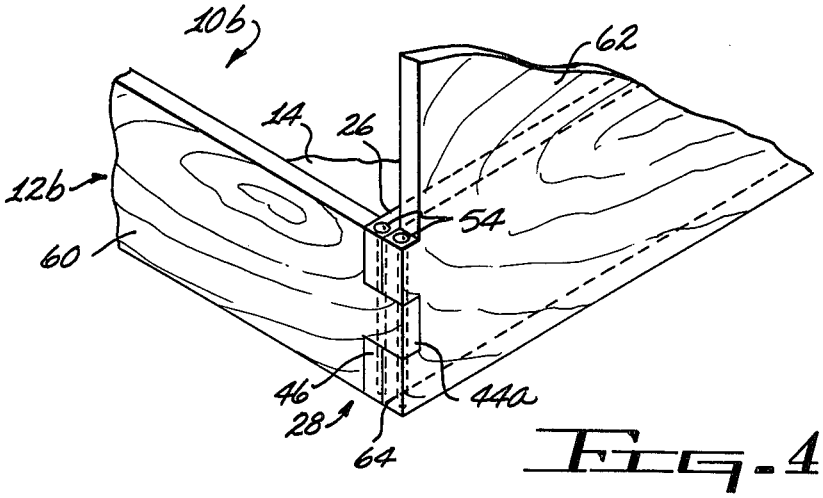
FIG. 4 is a fragmentary isometric view illustrating still another modification of the waterbed frame structure of the present invention.

Reference is now made to FIG. 4 wherein a fragmentary portion of a third embodiment of the waterbed frame structure of the present invention is indicated generally by the reference numeral 10*b*. In this third embodiment, all the various elements previously described with reference to the waterbed frame structure 10 are the same with the exception of the elongated side wall planks 20 and 22 of the mattress support frame 12 are replaced in the mattress support frame 12*b* by an identical pair of side wall planks 60 (one shown). The side wall planks 60 of this third embodiment are each provided with elongated tenons 44*a* (one shown) which protrudes beyond the end wall plank 26, but are otherwise the same as the previously described tenons 44 of the corner joints 28. In this manner, a headboard 62 of generally planar configuration, and having an open mortise 64 formed on each of the opposite lower corners (one shown), can be attached to the protruding tenons 44*a* with headed pins 54 as previously described with regard to the corner joints 28. Although the mattress support frame 12*b* is shown with the headboard 62 attached, it is to be understood that a footboard (not shown) can similarly be attached to the opposite end.

If desired, the headboard 62 can be attached to the tenon 44 of the corner joint 28 so as to completely replace the end wall plank 26, and the same can be accomplished by replacing the opposite end wall plank 24 with a suitable footboard (not shown). Thus, it is obvious that the end wall planks 24 and 26 can be configured substantially as shown in FIG. 1, or optionally in accordance with the configuration of the headboard 62 shown in FIG. 4.

While the principles of the invention have now been made clear in an illustrated embodiment, there will be immediately obvious to those skilled in the art, many modifications of structure, arrangements, proportions, the elements, materials, and components used in the practice of the invention, and otherwise, which are particularly adapted for specific environments and operation requirements without departing from those principles. The appended claims are therefore intended to cover and embrace any such modifications within the limits only of the true spirit and scope of the invention.

What I claim is:

1. A waterbed frame structure comprising:

a. a mattress support frame of open rectangular configuration having four wall members demountably interconnected by interlocking corner joints to form an endless upstanding wall;

b. a planar platform for supporting said mattress support frame; and c. said interlocking corner joints of said mattress support frame each comprising, I. a tenon extending intermediately from the end of one of the wall members of said mattress support frame, II. an open mortise formed in the end of the adjacent wall member of said mattress support frame, said open mortise having a spaced pair of projections separated by a gap into which said tenon is slidably straddingly positioned, III. said tenon and said open mortise having a three segment bore formed therethrough with a first segment thereof formed through one of said pair of projections of said open mortise, a second segment thereof formed through said tenon, and a third segment thereof formed through the other one of said pair of projections of said open mortise, and IV. an elongated headed pin slidably demountably positioned in said three segment bore formed through said tenon and said open mortise.

2. A waterbed frame structure as claimed in claim 1 wherein said tenon is located intermediate the end of the wall member of said mattress support frame from which it extends and has a height dimension which is approximately equal to one-third of the height dimension of that end.

3. A waterbed frame structure as claimed in claim 1 wherein said open mortise has a spaced pair of projections separated by a gap, said pair of projections and said gap each having a height dimension which is approximately equal to one-third of the height dimension of the end of the wall member of said mattress support frame in which said pair of projections and said gap are formed.

4. A waterbed frame structure comprising:

a. a mattress support frame of open rectangular configuration having a spaced pair of parallel side wall members and a spaced pair of end wall members interconnected to said pair of side wall members by demountably interlocking corner joints;

b. a planar platform upon which said mattress support frame is supported;

c. a pedestal frame of open rectangular configuration supportingly positioned below said planar platform; and d. said interlocking corner joints of said mattress support frame comprising, I. a tenon extending from each of the opposite ends of each of the side wall members of said mattress support frame, II. an open mortise formed in each of the opposite ends of each of the end wall members of said mattress support frame, III. each of said open mortises straddingly mounted on a different one of said tenons, IV. each of said open mortises and said tenons having a bore formed vertically therethrough, V. a headed pin demountably slidably positioned in each of the bores formed through said open mortises and tenons, and VI. at least two of said tenons being elongated to extend beyond the ones of said open mortises which are straddlingly mounted thereon, said elongated tenons aligned to extend beyond one of the end wall members of said mattress support frame.

5. A waterbed frame structure as claimed in claim 4 and further comprising a headboard demountably attached to said pair of elongated tenons.

6. A waterbed frame structure as claimed in claim 4 and further comprising:

a. a headboard of substantially planar configuration;

b. an open mortise formed in each of the lower corners of said headboard;

c. said headboard positioned so that each of said open mortises thereof are straddlingly mounted on a different one of said pair of elongated tenons;

d. each of said open mortises of said headboard having a vertical bore formed therethrough;

e. each of said pair of elongated tenons having a second vertical bore formed therethrough so as to align with the vertical bore of the one of said open mortises mounted thereon; and f. a pair of headed pins each demountably slidably positioned in a different one of the vertical bores formed in said open mortises of said headboard and in the one of said second bores of said tenons which align therewith.

* * * * *